US005477828A

United States Patent [19]

Barnes

[11] Patent Number: 5,477,828

[45] Date of Patent: Dec. 26, 1995

[54] METHOD FOR CONTROLLING A HYDRAULICALLY-ACTUATED FUEL INJECTION SYSTEM

[75] Inventor: Travis E. Barnes, Peoria, Ill.

[73] Assignee: Caterpillar Inc., Peoria, Ill.

[21] Appl. No.: 283,107

[22] Filed: Jul. 29, 1994

[51] Int. Cl.[6] ..... F02M 37/04; F02D 5/02

[52] U.S. Cl. ..... 123/446; 123/357; 123/478; 123/496

[58] Field of Search ..... 123/352, 478, 123/480, 357, 358, 359, 491, 496, 446, 500, 501

[56] References Cited

U.S. PATENT DOCUMENTS

| | | | |
|---|---|---|---|
| Re. 33,270 | 7/1990 | Beck et al. | 123/447 |
| 4,368,705 | 1/1983 | Stevenson et al. | 123/357 |
| 4,457,282 | 7/1984 | Muramatsu et al. | 123/480 |
| 4,572,132 | 2/1986 | Piwonka | 123/359 |
| 4,870,939 | 10/1989 | Ishikawa et al. | 123/506 |
| 4,884,546 | 12/1989 | Sogawa | 123/478 |
| 5,024,200 | 6/1991 | Free et al. | 123/501 |
| 5,113,833 | 5/1992 | Nagano et al. | 123/478 |
| 5,131,371 | 7/1992 | Wahl et al. | 123/458 |
| 5,143,291 | 9/1992 | Grinsteiner | 239/88 |
| 5,152,266 | 10/1992 | Sekiguchi et al. | 123/357 |
| 5,168,855 | 12/1992 | Stone | 123/446 |
| 5,176,115 | 1/1993 | Campion | 123/179.17 |
| 5,181,494 | 1/1993 | Ausman et al. | 123/446 |
| 5,191,867 | 3/1993 | Glassey | 123/446 |
| 5,245,970 | 9/1993 | Iwaszkiewicz et al. | 123/447 |
| 5,261,374 | 11/1993 | Gronenberg et al. | 123/501 |
| 5,293,853 | 3/1994 | Berger et al. | 123/357 |
| 5,313,924 | 5/1994 | Regueiro | 123/456 |
| 5,357,912 | 10/1994 | Barnes et al. | 123/357 |

FOREIGN PATENT DOCUMENTS 0149598 7/1985 European Pat. Off. .

OTHER PUBLICATIONS

Patent Appln. No. 08/023,279, filed Feb. 26, 1993, Entitled "Electronic Control System and Method For a Hydraulically–Actuated Fuel Injection System", Travis E. Barnes, Docket No. 92–105.

Sae Paper No. 930270, "Heui–A New Direction For Diesel Engine Fuel Systems", Glassey et al., International Congress and Exposition, Detroit, Mich., Mar. 1–5, 1993.

Sae Paper No. 930271, "Development of the Heui Fuel System–Integration of Design, Simulation, Test, and Manufacturing", Stockner et al., International Congress and Exposition, Detroit, Mich., Mar. 1–5, 1993.

Sae Paper No. 940586, "Benefits of New Fuel Injection System Technology on Cold Startability of Diesel Engines–Improvement of Cold Startability and White Smoke Reduction by Means of Multi Injection with Common Rail Fuel System (ECD–U2)", Osuka et al., International Congress and Exposition, Detroit, Mich., Feb. 28–Mar. 3, 1994.

*Primary Examiner*—Thomas N. Moulis

*Attorney, Agent, or Firm*—David M. Masterson

[57] ABSTRACT

In one aspect of the present invention a method is disclosed that controls the pressure of actuating fluid supplied to a hydraulically-actuated injector. A target time duration in which fuel is to be injected is determined, and compared to the actual time duration to determine a desired actuating fluid pressure in order to control the fuel injection rate.

8 Claims, 3 Drawing Sheets

METHOD FOR CONTROLLING A HYDRAULICALLY-ACTUATED FUEL INJECTION SYSTEM

TECHNICAL FIELD

The present invention relates generally to hydraulically-actuated fuel injection systems and, more particularly to electronic control systems for independently controlling the fuel injection rate and duration.

BACKGROUND ART

Known hydraulically-actuated fuel injector systems and/or components are shown, for example, in U.S. Pat. No. 5,191,867 issued to Glassey et al. on Mar. 9, 1993 and U.S. Pat. No. 5,181,494 issued to Ausman et al. on Jan. 26, 1993.

Such systems require an effective means for electronically controlling the fuel injection rate and duration while the engine is running under cold operating conditions.

The present invention is directed to overcoming one or more of the problems as set forth above.

DISCLOSURE OF THE INVENTION

In one aspect of the present invention a method is disclosed that controls the time duration over which a hydraulically-actuated injector injects fuel. An engine speed signal is used to determine a desired time duration signal that is used to electronically actuate the injector in order to control the fuel injection quantity.

In another aspect of the present invention a method is disclosed that controls the pressure of actuating fluid supplied to a hydraulically-actuated injector. A target time duration in which fuel is to be injected is determined, and compared to the actual time duration to determine a desired actuating fluid pressure to control the fuel injection rate.

BEST MODE FOR CARRYING OUT THE INVENTION

The present invention relates to an electronic control system for use in connection with a hydraulically actuated electronically controlled unit injector fuel system. Hydraulically actuated electronically controlled unit injector fuel systems are known in the art. One example of such a system is shown in U.S. Pat. No. 5,191,867, issued to Glassey on Mar. 9, 1993, the disclosure of which is incorporated herein by reference.

Figure 1:
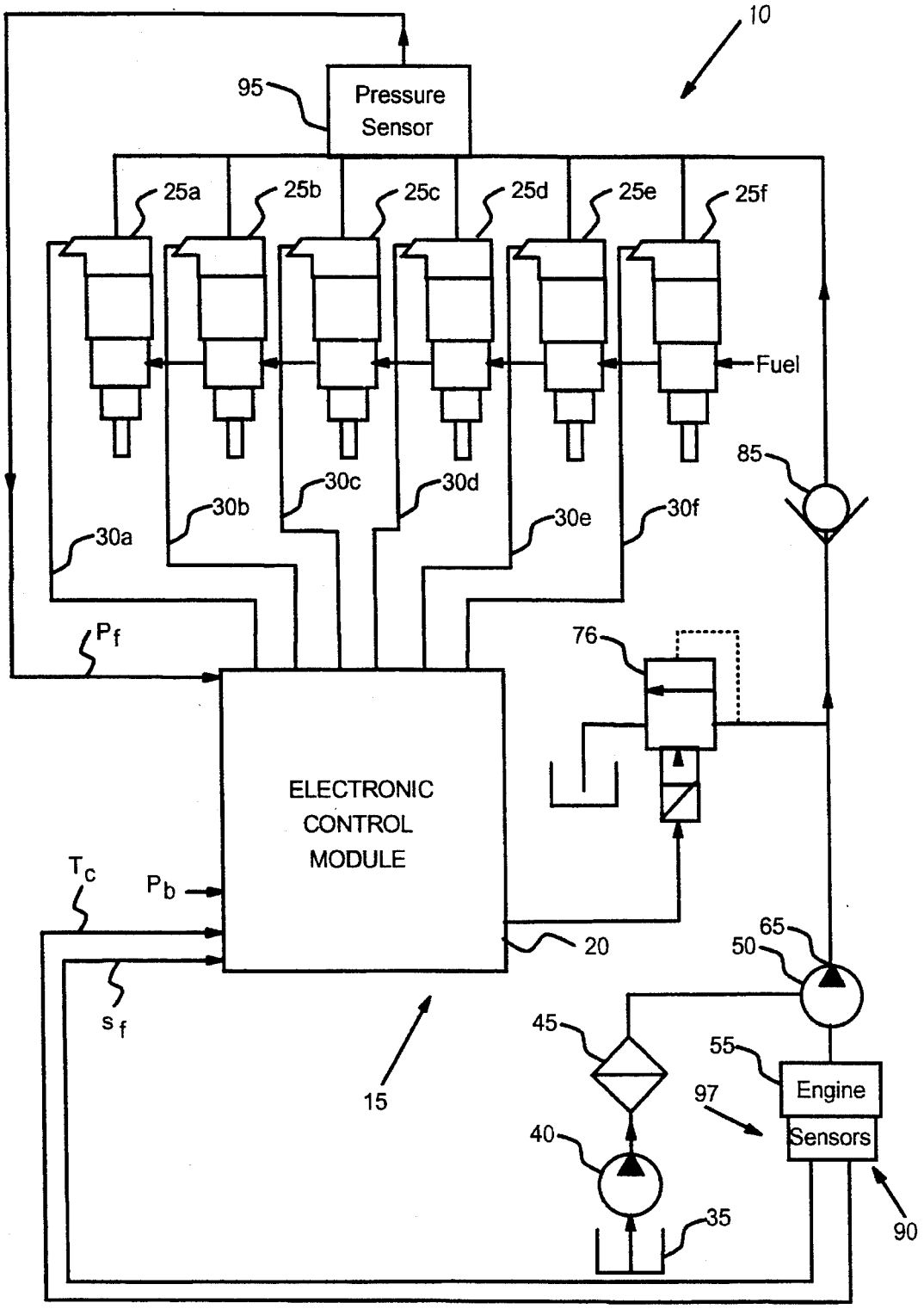
FIG. 1 is a diagrammatic general schematic view of a hydraulically-actuated electronically-controlled injector fuel system for an engine having a plurality of injectors.

Throughout the specification and figures, like reference numerals refer to like components or parts. Referring first to FIG. 1, a preferred embodiment of the electronic control system 10 for a hydraulically actuated electronically controlled unit injector fuel system is shown, hereinafter referred to as the HEUI fuel system. The control system includes an Electronic Control Module 15, hereinafter referred to as the ECM. In the preferred embodiment the ECM is a Motorolla microcontroller, model no. 68HC11. However, many suitable controllers may be used in connection with the present invention as would be known to one skilled in the art.

The electronic control system 10 includes hydraulically actuated electronically controlled unit injectors 25*a–f* which are individually connected to outputs of the ECM by electrical connectors 30*a–f* respectively. In FIG. 1, six such unit injectors 25*a–f* are shown illustrating the use of the electronic control system 10 with a six cylinder engine 55. However, the present invention is not limited to use in connection with a six cylinder engine. To the contrary, it may be easily modified for use with an engine having any number of cylinders and unit injectors 25. Each of the unit injectors 25*a–f* is associated with an engine cylinder as is known in the art. Thus, to modify the preferred embodiment for operation with an eight cylinder engine would require two additional unit injectors 25 for a total of eight such injectors 25.

Actuating fluid is required to provide sufficient pressure to cause the unit injectors 25 to open and inject fuel into an engine cylinder. In a preferred embodiment the actuating fluid comprises engine oil and the oil supply is the engine oil pan 35. Low pressure oil is pumped from the oil pan by a low pressure pump 40 through a filter 45, which filters impurities from the engine oil. The filter 45 is connected to a high pressure fixed displacement supply pump 50 which is mechanically linked to, and driven by, the engine 55. High pressure actuating fluid (in the preferred embodiment, engine oil) enters an Injector Actuation Pressure Control Valve 76, hereinafter referred to as the IAPCV. Other devices, which are well known in the art, may be readily and easily substituted for the fixed displacement pump 50 and the IAPCV. For example, one such device includes a variable pressure high displacement pump.

In a preferred embodiment, the IAPCV and the fixed displacement pump 50 permits the ECM to maintain a desired pressure of actuating fluid. A check valve 85 is also provided.

The ECM contains software decision logic and information defining optimum fuel system operational parameters and controls key components. Multiple sensor signals, indicative of various engine parameters are delivered to the ECM to identify the engine's current operating condition. The ECM uses these input signals to control the operation of the fuel system in terms of fuel injection quantity, injection timing, and actuating fluid pressure. For example, the ECM produces the waveforms required to drive the IAPCV and a solenoid of each injector 25.

The electronic control uses several sensors, some of which are shown. An engine speed sensor 90 reads the signature of a timing wheel applied to the engine camshaft to indicate the engine's rotational position and speed to the ECM. An actuating fluid pressure sensor 95 delivers a signal to the ECM to indicate the actuating fluid pressure. Moreover, an engine coolant temperature sensor 97 delivers a signal to the ECM to indicate engine temperature.

Figure 2:
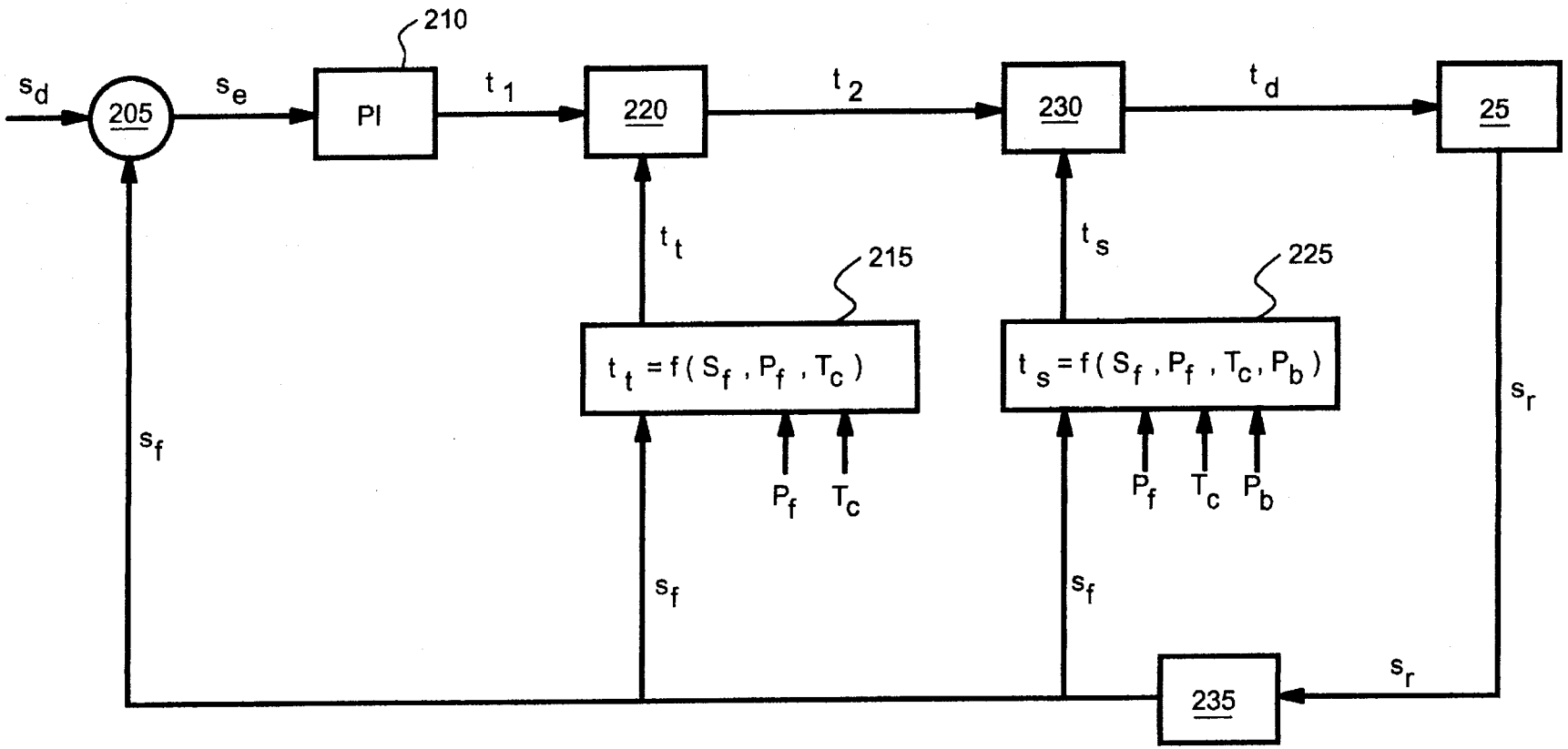
FIG. 2 is a block diagram of a time duration control strategy over which fuel is injected for the fuel system of FIG. 1.

The software decision logic for determining the time duration or the time window over which fuel is injected by each injector 25 is shown with respect to FIG. 2. A desired engine speed signal $s_d$ is produced from one of several possible sources such as operator throttle setting, cruise control logic, power take-off speed setting, or environmentally determined speed setting due to, for example, engine coolant temperature. A speed comparing block 205 compares the desired engine speed signal $s_d$ with an actual engine speed signal $s_f$ to produce an engine speed error signal $s_e$. The engine speed error signal $s_e$ becomes an input to a Proportional Integral (PI) control block 210 whose output is a first time duration signal $t_1$. The PI control calculates a desired time duration over which fuel is to be injected to accelerate or decelerate the engine speed to result in a zero engine speed error signal $s_e$. Note that, although a PI control is discussed, it will be apparent to those skilled in the art that other control strategies may be utilized.

The first time duration signal $t_1$ is then preferably compared to the maximum allowable time duration $t_t$ at comparing block 220. The maximum allowable time duration $t_t$ is produced by block 215, which includes one or more map(s) and/or mathematical equation(s). More particularly, block 215 receives the actual engine speed signal $s_f$, an actual fluid pressure signal $P_f$ and an actual coolant temperature signal $T_c$, and produces the maximum allowable time duration signal $t_t$ that preferably determines the horsepower and torque characteristics of the engine 25. The comparing block 220 compares the maximum allowable time duration signal $t_t$ to the first time duration signal, and the lower of the two values becomes a second time duration signal $t_2$.

The second time duration signal $t_2$ may then be compared to another maximum allowable fuel quantity signal $t_s$ at comparing block 230. The maximum allowable fuel quantity signal $t_s$ is produced by block 225, which includes an emissions limiter map and/or equation(s) 50 that is used to limit the amount of smoke produced by the engine 25. The emissions limiter block 225 preferably has several possible inputs including an air inlet pressure signal $P_b$ indicative of, for example, air manifold pressure or boost pressure. The maximum allowable fuel quantity signal $t_s$ that limits the quantity of fuel based on the quantity of air available to prevent excess smoke. Note that although two limiting blocks 215,225 are shown, it may be apparent to those skilled in the art that other such blocks may be employed.

The comparing block 230 compares the maximum allowable time duration signal $t_s$ to the second time duration signal $t_2$, and the lower of the two values becomes the actual time duration signal $t_d$. The actual time duration signal $t_d$ is used to determine how long the current (I) to the solenoid of a respective injector 25 should remain "on" to inject the correct quantity of fuel. Preferably, the raw actual engine speed signal $s_r$ is conditioned by means 235, such as a noise filter and/or frequency to digital convertor, to eliminate noise and convert the signal to a usable form.

Figure 3:
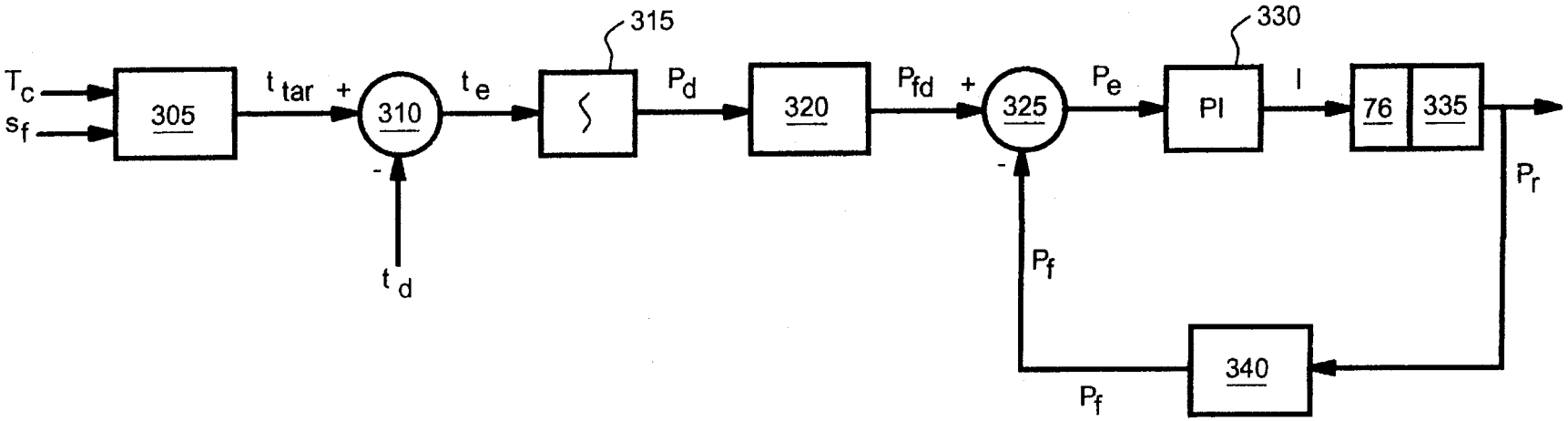
FIG. 3 is a block diagram of an actuating fluid pressure control strategy for the fuel system of FIG. 1.

The software decision logic for determining the magnitude of the actuating fluid pressure supplied to the injector 25 is shown with respect to FIG. 3. A target fuel injection duration signal $t_{tar}$, which is indicative of a desired time duration that fuel is to be injected is produced by block 305. Preferably, the target duration signal $t_{tar}$ is a function of the actual engine speed $s_f$ and coolant temperature $T_c$. The target duration signal $t_{tar}$ is then compared with the actual time duration signal $t_d$ at block 310, which produces a time duration error signal $t_e$.

The time duration error signal $t_e$ is integrated at block 315, which produces a desired actuating fluid pressure signal $P_d$. The desired actuating fluid pressure signal $P_d$ is then filtered by a low pass filtering means 325 to produce a filtered desired actuating fluid pressure signal $P_{fd}$ to slow the system response. The filtered desired actuating fluid pressure signal $P_{fd}$ is then compared at block 325 with the actual actuating fluid pressure signal $P_f$ to produce an actuating fluid pressure error signal $P_e$.

The actuating fluid pressure error signal $P_e$ is input to a PI control block 330 whose output is a desired electrical current (I) applied to the IAPCV. By changing the electrical current (I) to the IAPCV the actuating fluid pressure $P_f$ can be increased or decreased. For example, increasing the current (I) to the IAPCV causes the IAPCV to bypass the actuating fluid directly to the sump 97 at a higher pressure thereby increasing the actuating fluid pressure. Decreasing the current (I) to the IAPCV causes the IAPCV to bypass actuating fluid to the sump 97 at a lower pressure thereby decreasing the actuating fluid pressure. The PI control 330 calculates the electrical current (I) to the IAPCV that would be needed to raise or lower the actuating fluid pressure $P_f$ to result in a zero actuating fluid pressure error signal $P_e$. The resulting actuating fluid pressure is used to hydraulically actuate the injector 25. Note that, although a PI control is discussed, it will be apparent to those skilled in the art that other control strategies may be utilized. Preferably, the raw actuating fluid pressure signal $P_r$ in the high pressure portion of the actuating fluid pressure circuit 335 is conditioned and converted by a conventional means 340 to eliminate noise and convert the signal to a usable form.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

Typically, engine starting includes three engine speed ranges. For example, from 0–200 RPM the engine is said to be cranking (cranking speed range). Once the engine fires, then the engine speed accelerates from engine cranking speeds to engine running speeds (acceleration speed range). Once the engine speed reaches a predetermined engine RPM, e.g. 900 RPM, then the engine is said to be running (running speed range). The present invention is concerned with controlling the fuel injection during engine running speeds—especially where the engine temperature is below a predetermined temperature, e.g. 18° Celsius.

As the engine speed increases, the time in which fuel may be injected decreases. Accordingly, the present invention increases the desired actuating fluid pressure to increase the fuel injection rate in response to increasing engine speed. Consequently, the desired actuating fluid pressure is determined in response to the a target injection window and an actual injection window. This way, the desired amount of fuel is injected during the target window to maintain the engine acceleration.

The ECM controls the actuating fluid pressure which controls the fuel injection pressure and thus fuel quantity. Operational maps and/or mathematical equations stored in the ECM programmable memory identify the optimum actuating fluid pressure for best engine performance.

The HEUI fuel system provides many unique injection characteristics. Chief among these is injection pressure control over the entire engine speed range. In a typical mechanically-actuated fuel system, the injection pressure increases proportionally with engine speed while the injection pressure in the HEUI fuel system is electronically controlled independent of engine speed. The ability for independent electronic control of injection pressure has proven advantages in smoke and particulate reduction and in greatly improved low speed engine response.

Since the HEUI fuel system is time based, injection characteristics are independent of engine speed—unlike typical mechanically-actuated fuel systems whose characteristics slow down as engine speed is reduced. A benefit of a time based system is complete flexibility in controlling injection timing. Injection timing can be optimized without concern for engine cam profile limitations. This flexibility provides proven advantages in lower emissions, reduced noise, reduced smoke, improved hot and cold starting, white smoke clean-up, and high altitude operation.

Other aspects, objects, and advantages of this invention can be obtained from a study of the drawings, the disclosure, and the appended claims.

I claim:

1. A method for electronically controlling a quantity of fuel that a hydraulically-actuated injector (25) injects into an engine (55), the method comprising the steps of:

determining a desired time duration indicative of a desired time period that fuel is to be injected, and producing a first time duration signal ($t_1$) indicative of the magnitude of the desired time duration;

determining a maximum allowable time duration that fuel is to be injected that limits at least one characteristic produced by the engine, and producing a maximum allowable time duration signal ($t_t$,$t_s$) indicative of the magnitude of the maximum allowable time duration; and comparing the first time duration signal ($t_1$) to the maximum allowable time duration signal ($t_t$,$t_s$), selecting a lesser value of the first time duration signal ($t_1$) and the maximum allowable time duration signal ($t_t$,$t_s$), and delivering an actual time duration signal ($t_d$) to the injector (25) to electronically control the fuel quantity.

2. A method, as set forth in claim 1, including the steps of:

sensing a desired engine speed and producing a desired engine speed signal ($s_d$) indicative of the sensed desired engine speed;

sensing an actual engine speed and producing a actual engine speed signal ($s_f$) indicative of the sensed engine speed;

comparing the desired with the actual engine speed signal and producing an engine speed error signal ($s_e$) in response to the difference in magnitude between the compared signals; and receiving the engine speed error signal ($s_e$) and determining the first time duration signal ($t_1$) to adjust the actual engine speed to cause the engine speed error signal ($s_e$) to approach a zero magnitude.

3. A method, as set forth in claim 2, including the steps of:

determining a maximum allowable time duration in which fuel is to be injected that limits engine torque, and producing a maximum allowable time duration signal ($t_t$) indicative of the magnitude of the maximum allowable time duration; and comparing the first time duration signal ($t_1$) with the maximum allowable fuel quantity signal ($t_t$), selecting a lesser value of the compared signals ($t_1$,$t_t$), and delivering a second time duration signal ($t_2$) indicative of the magnitude of the selected lesser value.

4. A method, as set forth in claim 3, including the steps of:

determining another maximum allowable time duration in which fuel is to be injected that limits engine emissions, and producing another maximum allowable time duration signal ($t_s$) indicative of the magnitude of the another maximum allowable time duration; and comparing the second time duration signal ($t_2$) with the another maximum allowable time duration signal ($t_s$), selecting another lesser value of the compared signal ($t_2$,$t_s$), and producing the actual time duration signal ($t_d$).

5. A method for electronically controlling the actuating fluid pressure supplied to a hydraulically-actuated injector (25) that injects fuel into an engine (55), comprising the steps of:

determining a desired time duration indicative of a desired time period that fuel is to be injected, and producing a target duration signal ($t_{tar}$) indicative of the magnitude of the desired time duration;

sensing an actual time duration over which the injector (25) is injecting fuel, and producing an actual time duration signal ($t_d$) indicative of the magnitude of the actual time duration;

comparing the target duration signal ($t_{tar}$) with the actual time duration signal ($t_d$), and determining a desired actuating fluid pressure signal ($P_d$) indicative of the magnitude of the desired actuating fluid pressure based on the difference between the compared signals ($t_{tar}$,$t_d$); and receiving the desired actuating fluid pressure signal ($P_d$), and producing a desired electrical current signal (I) to control the fuel injection rate.

6. A method, as set forth in claim 5, including the steps of:

sensing an actual actuating fluid pressure and producing an actual actuating fluid pressure signal ($P_f$) indicative of the magnitude of the sensed actuating fluid pressure;

comparing the desired actuating fluid pressure signal ($P_d$) with the actual actuating fluid pressure signal ($P_f$) and producing an actuating fluid pressure error signal ($P_e$) in response to a difference between the compared actuating fluid pressure signals ($P_d$,$P_f$); and receiving the actuating fluid pressure error signal ($P_e$), determining a desired electrical current based on the actuating fluid pressure error signal ($P_e$), and producing a desired electrical current signal (I).

7. A method, as set forth in claim 6, including the steps of:

sensing an actual engine speed and producing an actual engine speed signal ($s_f$) indicative of the sensed engine speed;

sensing an actual engine temperature and producing an actual engine temperature signal ($T_c$) indicative of the sensed engine temperature; and receiving the actual engine speed and temperature signals ($s_f$,$T_c$), and determining the target duration signal ($t_{tar}$) based on the actual engine speed and temperature signals ($s_f$,$T_c$).

8. A method, as set forth in claim 7, including the steps of:

receiving and converting the time duration error signal ($t_e$) into the desired actuating fluid pressure signal ($P_d$) in response to integrating the time duration error signal ($t_e$); and receiving and filtering the desired actuating fluid pressure signal in order to slow the system response.

* * * * *